US005308079A

United States Patent [19]

Dreznick et al.

[11] Patent Number: 5,308,079

[45] Date of Patent: May 3, 1994

[54] BOARD GAME APPARATUS AND METHOD FOR PLAYING SAME

[75] Inventors: Elliott Dreznick, 3 Sylvan La., Pt. Jefferson Station, N.Y. 11776; Jeffrey Dreznick, 97 Haverhill Rd., Trumbull, Conn. 06611; Howard Futerman, Port Jefferson Station, N.Y.

[73] Assignees: Elliott Dreznick, Port. Jeff. Sta., N.Y.; Jeffrey Dreznick, Trumbull, Conn.

[21] Appl. No.: 22,075

[22] Filed: Feb. 24, 1993

[51] Int. Cl.[5] ..... A63F 3/00; A63F 9/18

[52] U.S. Cl. ..... 273/249; 273/431; 273/432

[58] Field of Search ..... 273/249, 250, 253, 248, 273/431, 432

[56] References Cited

U.S. PATENT DOCUMENTS

| | | | |
|---|---|---|---|
| 1,391,333 | 9/1921 | McManus | 273/249 |
| 2,792,227 | 5/1957 | Auerbach | 273/249 |
| 4,124,214 | 11/1978 | Pavis | 273/249 |
| 4,557,485 | 12/1985 | Lardon | 273/249 |
| 4,907,808 | 3/1990 | Turner et al. | 273/240 |
| 4,923,198 | 5/1990 | Diaz | 273/240 |
| 5,013,048 | 5/1991 | Turner | 273/242 |
| 5,048,842 | 9/1991 | Proctor | 273/248 |
| 5,071,134 | 12/1991 | Burroughs | 273/249 |
| 5,083,794 | 1/1992 | Santagata | 273/249 |

*Primary Examiner*—Benjamin H. Layno

*Attorney, Agent, or Firm*—Collard & Roe

[57] ABSTRACT

A board game apparatus and method for playing same requiring the demonstration of knowledge of deceased individuals, the circumstances surrounding their deaths, and the like, on the part of the players of the game. A game board is provided which has a continuous spiral course including several colored spaces defining a predetermined number of colorations. Several distinctive death-related markers are moved along the colored spaces by a different one of the players in playing the game. Several decks of question-posing cards containing questions relating to deceased individuals, the circumstances surrounding their deaths, and the like, is provided. Each deck contains a category of questions corresponding to one of the predetermined colors. A die directs random movement of the markers along the spiral course. An individual player effects operation of the die to advance the player's marker to a space having a predetermined color, and selects a question-posing card from the deck corresponding to that color. Upon proper response to the question-posing card, the player is directed to repeat operation of the die to further advance the player's marker and select another question-posing card.

9 Claims, 3 Drawing Sheets

BOARD GAME APPARATUS AND METHOD FOR PLAYING SAME

BACKGROUND OF THE INVENTION

1. Field of the Invention

The present invention relates generally to the field of board games and more particularly, to board games in which players may demonstrate knowledge of deceased individuals and the circumstances surrounding their deaths for advancement during the course of the game. More particularly, it relates to a board game where advancement of a player's marker results in a selection of a category of questions to which a correct response earns the player a further opportunity for advancement.

2. The Prior Art

Various board games for educational and amusement purposes are known from the prior art. The Diaz U.S. Pat. No. 4,923,198, discloses a board game of geopolitical and related knowledge. More specifically, it discloses a board game using geographical, historical, political and sociological knowledge and the like for teaching and testing the players.

The Santagata U.S. Pat. No. 5,083,794, discloses a trivia game which directs association with the decade of the 1950s and provides educational entertainment in association with an understanding of various categories of knowledge of that decade.

The Pavis U.S. Pat. No. 4,124,214, discloses an interpretive game with players' scoring for advancement determined by the answering response of the player, with each of several possible responses having various answer values.

Other games are disclosed in U.S. Pat. Nos. 1,391,333; 5,013,048; and 5,048,842. However, none of these prior art patents discloses a game requiring the demonstration of knowledge of deceased individuals and the circumstances surrounding their deaths and the like.

SUMMARY OF THE INVENTION

It is therefore an object of the present invention to provide a board game apparatus and method for playing same requiring the demonstration of knowledge of deceased individuals and the circumstances surrounding their deaths and the like.

It is a further object of the present invention to provide a recreational game which will educate its players.

It is still a further object of the present invention to provide a board game using knowledge of deceased individuals and the circumstances surrounding their deaths to advance players to a final "guess who died" category of questions.

These and other related objects are achieved according to the invention by a board game apparatus requiring the demonstration of knowledge of deceased individuals and the circumstances surrounding their deaths and the like, on the part of the players of the game. A game board is provided which has a continuous spiral course thereon, including a plurality of colored spaces defining a predetermined number of colorations. Several distinctive death-related markers are moved along the colored spaces by a different player in playing the game. A plurality of decks of question-posing cards containing questions relating to deceased individuals, the circumstances surrounding their death or the like are provided. Each deck contains a category of questions and corresponds to one of the predetermined colors on the game board.

Chance means directs random movement of the markers along the spiral course. An individual player effects operation of the chance means to advance the player's marker to a space having a predetermined color. An opposing player then selects a question-posing card from the deck corresponding to the color and, upon proper response to the question-posing card, is directed to repeat operation of the chance means to further advance the player's marker and select another question-posing card.

The continuous spiral course includes a periphery and a center. The several distinctive death-related markers begin at the periphery of the spiral course and advance along a plurality of colored spaces toward the center of the spiral course. The game board includes a terminal space at the center of the spiral course which has a color different than the other colored spaces. The game includes a separate deck of question-posing cards corresponding to the terminal space. Timing means are provided to limit the period of time in which an individual player has to respond to a question-posing card selected from the separate deck following advancement of the player's marker to the terminal space.

The continuous spiral course includes a repeating pattern of colored spaces, beginning at the periphery and ending at the center of the game board. The game board additionally includes at least one key located on the game board adjacent to the continuous spiral course for correlating a category of questions to each color.

The method of playing a board game according to the invention includes the steps of providing a game board having a continuous spiral course including a plurality of colored spaces defining a predetermined number of colorations. Each player is provided with a distinctive death-related marker. A plurality of decks of question-posing cards are provided concerning deceased individuals, the circumstances surrounding their deaths or the like. Each deck corresponds to one of the predetermined colors. A chance member is operated to advance a player's marker a random number of spaces along the spiral course. A question-posing card is selected from the deck corresponding to the color of the space to which the marker was advanced. The steps of operating a chance member and selecting a question-posing item are repeated if the player's response to the question-posing is correct.

BRIEF DESCRIPTION OF THE DRAWINGS

Other objects and features of the present invention will become apparent from the following detailed description considered in connection with the accompanying drawings which discloses an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
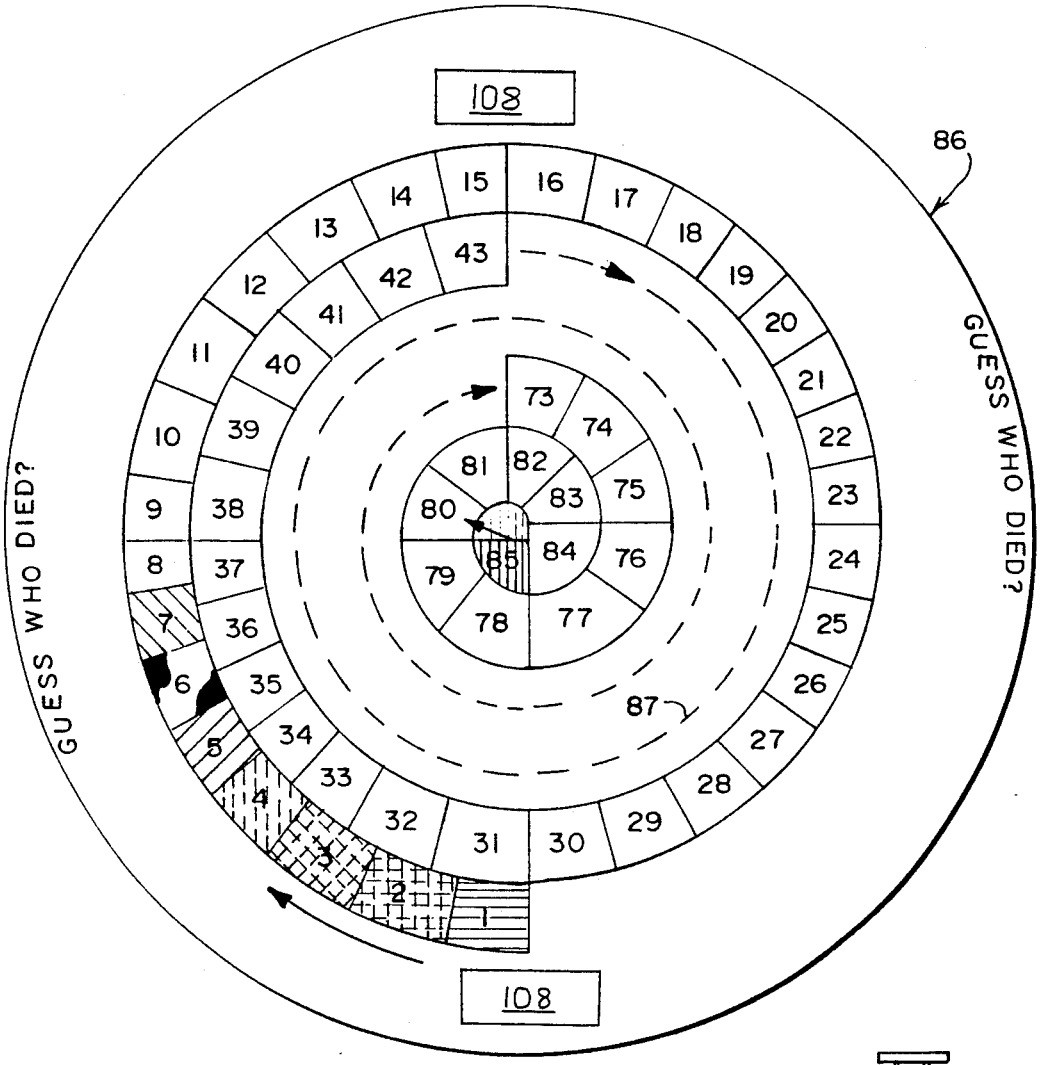
FIG. 1 is a top plan view of the board game apparatus according to the invention.

Turning now in detail to the drawings, and in particular FIG. 1, there is shown a game board 86 containing a continuous spiral course 87 of individual spaces 1-84. Game board 86 can be of any shape, i.e., circular or square, and may be designed for folding in half or quarters for easy storage within a box. Spiral course 87 begins at the periphery with space 1, and proceeds consecutively along spaces 2, 3, 4, etc. in ascending order to space 84. A terminal space 85 is located adjacent to space 84 and space 78, 79 or 80, for example.

Figure 2:
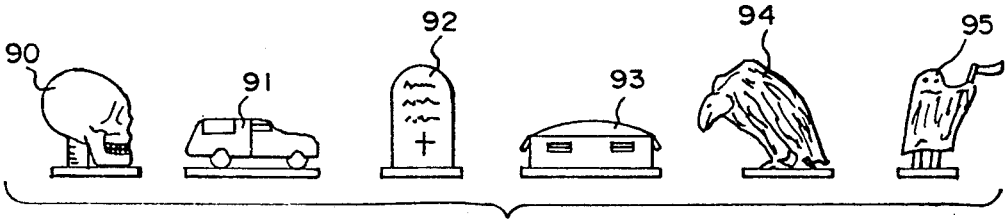
FIG. 2 is a perspective view of the death-related markers which are moved along the game board.

As can be seen in FIG. 2, several distinctive death-related markers or game pieces are shown, for example, a skull 90, a hearse 91, a tombstone 92, a coffin 93, a vulture 94 and a grim reaper FIG. 95. These markers 90-95 may assume any shape desired, so long as they are distinguishable from each and easily fit on a space 1-84.

Figure 3:
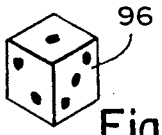
FIG. 3 is a perspective view of a die.

FIG. 3 discloses a die 96 which is used to determine how many spaces a player will advance his or her marker 90-95 during a turn. Alternatively, other means may be employed to generate random number values to direct a player's marker, for example, a spinner or other mechanical or electronic means.

Figure 4:
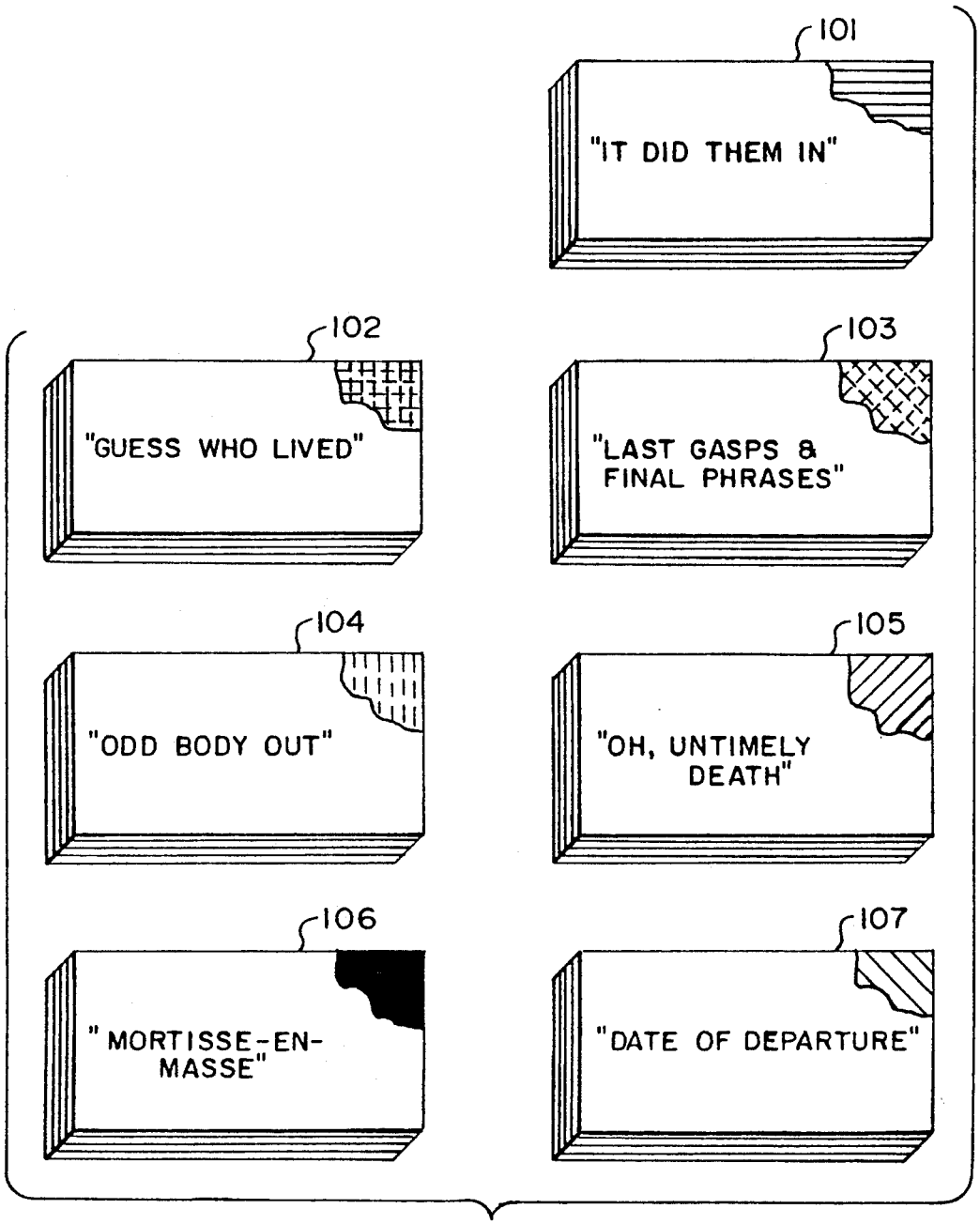
FIG. 4 is a perspective view of several decks of cards corresponding to colors on the game board.

Referring now to FIG. 4, there is shown seven decks of cards 101-107, with each deck including questions within a particular category. An example of various categories is as follows.

Deck 101 includes questions under the category "It Did Them In." This category deals with the cause of a celebrity's death. The questions may provide a celebrity's name and then ask what the cause of death was. Alternatively, the card may give the cause of death with some additional information and then ask the identity of the dead celebrity.

Deck 102 includes questions in the category "Guess Who Lived." This category gives questions on last survivors or first casualties of groups of famous people. For example, a player may be asked to identify a last survivor or first casualty of a television show, movie, band, etc. A player may also be asked to identify famous widows or widowers.

Deck 103 includes questions in the category of "Last Gasps and Final Phrases." These questions will ask a player to identify a dead celebrity based on the celebrity's final spoken words, epitaph or final accomplishment.

Deck 104 includes questions in the category of "Odd Body Out." These questions will provide the names of several late celebrities and ask the player to determine which celebrity does not belong. The "Odd Body Out" will generally focus on the cause of death. This category is not intended to discriminate among the dead, and therefore the answer cannot be selected based on age, sex, race or religion. Similarly, the question cannot be based on accomplishments before the individual passed away.

Deck 105 includes questions in the category of "Oh, Untimely Death." This category pertains to untimely, unnatural or mysterious deaths.

Deck 106 includes questions in the category of "Mortisse-en-Masse." This category relates to disasters or catastrophes which resulted in multiple deaths.

Deck 107 includes questions in the category of "Date of Departure." The cards will supply a celebrity's date of death and a clue, and ask the player to identify the dead celebrity.

As can be appreciated, the categories listed above are merely exemplary of categories which can be created which relate generally to deceased individuals. The above list of categories is not intended to represent a complete or exhaustive list, but is merely illustrative of certain popular categories.

Figure 5:
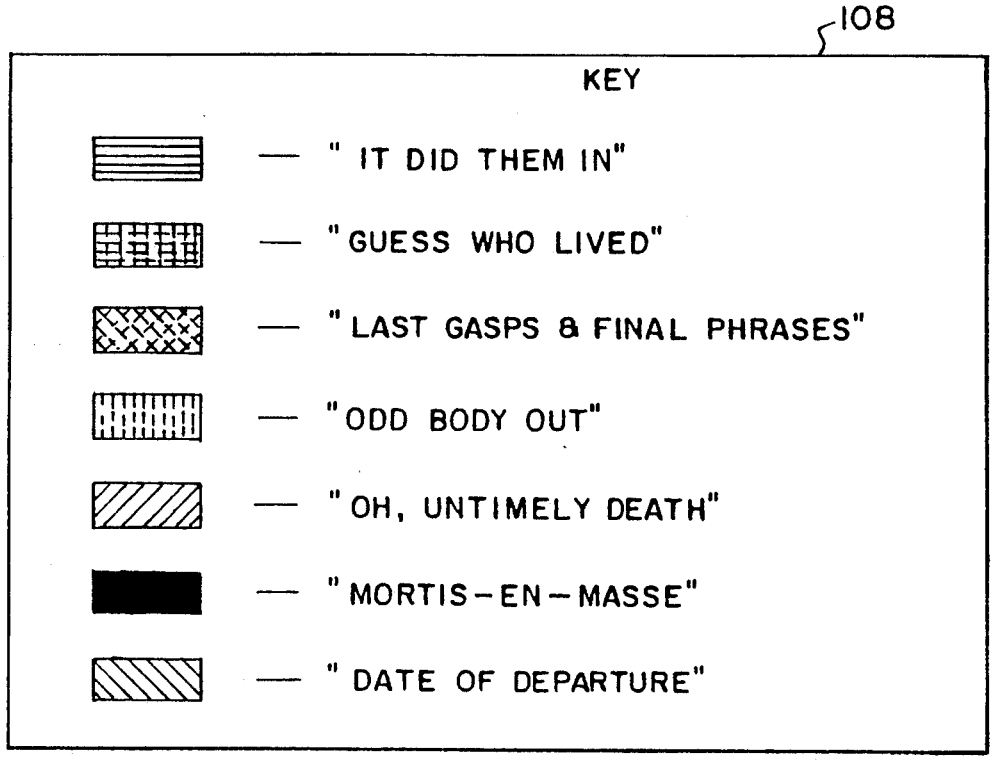
FIG. 5 is a key for correlating the colors on the game board to the several decks of cards.

As can be seen in FIG. 5, there is shown a key card 108 which keys a particular color to a certain category. Key cards 108 may be distributed to individual players, or can be mounted directly onto game board 86 adjacent to spiral course 87 for easy viewing by the game participants. Each space 1-84 on game board 86 may be provided with a color, for example, spaces 1-7 may be colored blue, yellow, orange, purple, brown, black and green, respectively. If a player's marker lands on space 4, for example, which is purple, key card 108 on game board 86 keys purple to the category of "Odd Body Out," i.e., deck 104. The player would then be asked to respond to a question from a card in deck 104.

In a preferred embodiment of the invention, decks 101-107 would each be provided with a color that corresponds directly to the colors of spaces 1-84 on game board 86. In this manner, when a marker 90-95 is moved to a new colored space, a deck 101-107 can be easily selected based on its color match with the space. The top card of the selected deck is then picked by an opposing player, and the question is read to the player whose turn it is, for example.

To begin the game, each player selects a game piece 90-95. Each player then rolls the die to determine the order of play. The player having the high roll of the die goes first. After rolling the die, the player moves in a one-way circular fashion, beginning with space 1. After arriving at a space, for example, space 1, 2, 3, 4, 5 or 6, key card 108 is consulted to see which category corresponds to the space landed upon. The player must then respond to a question-posing card selected from the appropriate deck 101-107. A player will continue to roll die 96, advance his or her marker, and answer a question until an incorrect answer is provided. At that point the player relinquishes his or her turn to the next player. Each player attempts as many correct responses as possible in order to advance along spiral course 87 to the higher numbered spaces.

Figure 8:
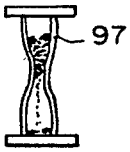
FIG. 8 is a side elevational view of a timer.
Figure 6:
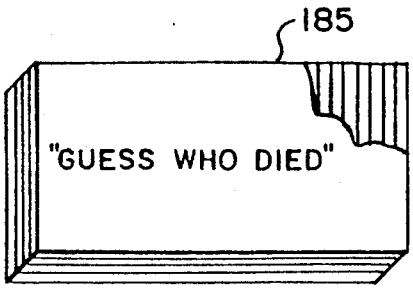
FIG. 6 is a perspective view of a separate deck of cards for the terminal space.

Once a player's marker has advanced to space 79, 80, 81, 82, 83 or 84, the player must roll a 6, 5, 4, 3, 2, or 1, respectively, to land exactly on terminal space 85. If a player's marker is on space 83, and the next roll of die 96 yields a number greater than 2, the marker must be advanced past terminal space 85, out space 80 (as in FIG. 1), and continued in unidirectional fashion en route to terminal space 85. Terminal space 85 is provided with a color different from all the other colors on key card 108 and on decks 101-107, for example, pink. Once a player successfully lands on terminal space 85, then a pink card is chosen from deck 185 shown in FIG. 6. Once the question is read, a timer 97, as shown in FIG. 8, is started. The player is then given a predetermined amount of time in which to answer the question.

Figure 7:
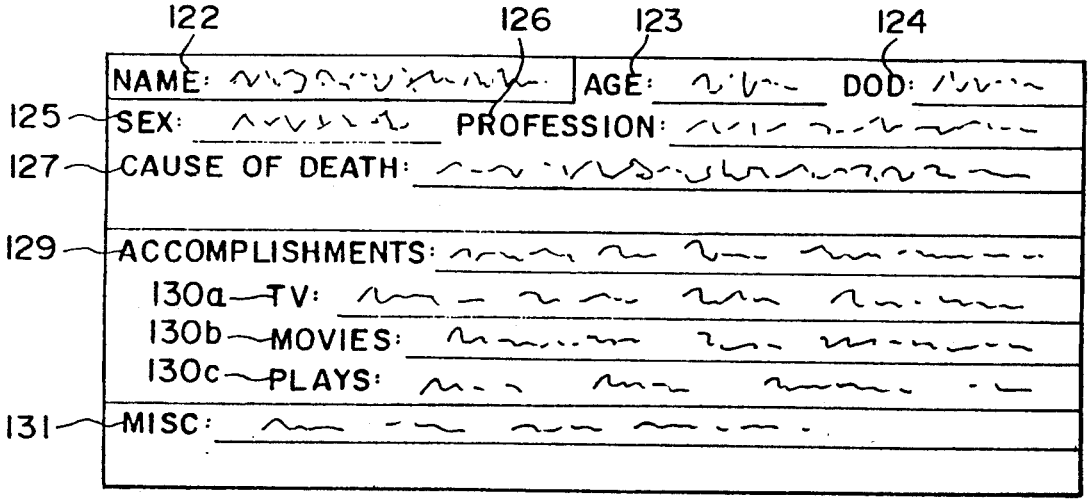
FIG. 7 is a top plan view of a question-posing card for the terminal space.

Deck 185 includes questions in the category of "Guess Who Died?" These questions provide the deceased's age at death and date of death, for example. FIG. 7 is an example of a card selected from deck 185. The card has various categories, for example, name 122, age 123, date of death 124, sex 125, profession 126, cause of death 127, accomplishments 129, including exemplary subcategories TV 130*a*, movies 130*b*, plays 130*c* and miscellaneous 131. When the deceased's age at death and date of death are being read to the player, care should be taken not to accidentally reveal the deceased's name. The timer is then immediately started, allowing the player several minutes to guess the mystery celebrity's identity. During the several minutes, the player may inquire as to the deceased's gender, profession, cause of death, etc. These additional clues may be provided to the player only upon specific request. Other, more detailed information may only be revealed to the player in yes/no question-and-answer format, for example. The deceased celebrity's best known accomplishments may be indicated by an asterisk, where applicable.

During the allotted time period, the player is allowed to continue to ask questions and even continue to guess the mystery celebrity's identity (even if the guesses are incorrect).

If the player correctly guesses the deceased celebrity's identity in the allotted period of time, that player is then declared the winner. If the player cannot guess the identity of the deceased in the allotted time, that player must exit terminal space 85 back onto spiral course 87 via space 80 on the player's next turn. For example, following an unsuccessful turn, a player in terminal space 85 will then be placed back onto the board via space 80 (on the player's next turn). The player must continue to answer questions on categories corresponding to spaces 80–84 en route to terminal space 85. On a subsequent turn, the player must land back onto terminal space 85 in order to resume play in the "Guess Who Died" category. Once there, the player has the option of continuing to guess the identity of the deceased celebrity on the "Guess Who Died" card 185 from the previous turn. Alternatively, the player may choose to guess from a new "Guess Who Died" card, randomly picked by an opposing player.

While several embodiments of the present invention have been shown and described, it is to be understood that many changes and modifications may be made thereunto without departing from the spirit and scope of the invention as defined in the appended claims.

What is claimed is:

1. A board game apparatus requiring the demonstration of knowledge of deceased individuals and the circumstances surrounding their deaths, and the like, on the part of the players of the game, comprising:

a game board having a continuous spiral course including a periphery, a center and radii extending between said periphery and said center and a plurality of colored spaces defining a predetermined number of colorations, said plurality of colored spaces being arranged in a repeating pattern beginning at said periphery and ending at said center;

a terminal space located at said center of said game board having a color different from said plurality of colored spaces;

said plurality of colored spaces that lie along a radius of said game board being contiguous with each other;

said terminal space being contiguous with at least one of said plurality of colored spaces located on the spiral course several spaces preceding the terminal space, said terminal space having a marking connecting the terminal space to the contiguous preceding space indicating a continued path of travel from the terminal space to said contiguous preceding space to form a closed circular course within said continuous spiral course at said center of said game board;

several distinctive death-related markers, each of said markers being moved along said colored spaces and said terminal space by a different one of said players in playing said game;

a plurality of decks of question-posing cards containing questions relating to deceased individuals, the circumstances surrounding their deaths, or the like, each deck containing a category of questions corresponding to one of said predetermined colors, and the color of said terminal space; and chance means for directing random forward movement of said markers along said spiral course and subsequently around said closed circular course, wherein an individual player effecting operation of said chance means to advance the player's marker to a space and selecting a question-posing card from the deck corresponding to the color and, upon proper response to the question-posing card, is directed to repeat operation of said chance means to further advance the player's marker and select another question-posing card, until a proper response is elicited from a player located on said terminal space.

2. The board game apparatus according to claim 1, wherein said several distinctive death-related markers begin at the periphery of said spiral course and advance along said plurality of colored spaces toward the center of said spiral course.

3. The board game apparatus according to claim 2, additionally including timing means for providing a preset period of time for an individual player to respond to a question-posing card selected from the separate deck following advancement of the player's marker to said terminal space.

4. The board game apparatus according to claim 3, wherein said game board additionally includes at least one key located on said game board adjacent to said continuous spiral course, said key correlating a category of questions to each of said plurality of colors.

5. The apparatus according to claim 4, wherein said categories of questions comprise:

a) the cause of an individual's death;
b) the first casualty of a group;
c) the last survivor of a group;
d) final spoken words;
e) epitaphs;
f) final accomplishments;
g) which individual does not belong;
h) untimely deaths;
i) unnatural deaths;
j) mysterious deaths;
k) multiple deaths; and
l) date of departure.

6. The apparatus according to claim 5, wherein said several distinctive death-related markers comprise a skull, a hearse, a tombstone, a coffin, a vulture and a grim reaper figure.

7. A method of playing a board game requiring the demonstration of knowledge of deceased individuals, the circumstances surrounding their deaths, and the like, by several players, comprising the steps of:

providing a game board having a continuous spiral course including a periphery, a center and radii extending between said periphery and said center and a plurality of colored spaces defining a predetermined number of colorations, said plurality of colored spaces being arranged in a repeating pattern beginning at said periphery and ending at said center;

providing a terminal space at said center of said game board having a color different from said plurality of colored spaces;

positioning said plurality of colored spaces that lie along a radius of said game board contiguous to each other;

positioning said terminal space contiguously to at least two of said plurality of colored spaces to form a closed circular course within said continuous spiral course at said center of said game board;

providing each player with a distinctive death-related marker;

providing a plurality of decks of question-posing cards containing questions relating to deceased individuals, the circumstances surrounding their deaths, or the like, each deck containing a category of questions corresponding to one of said predetermined colors and the color of said terminal space;

operating a chance member to advance a player's marker a random number of spaces along said spiral course and subsequently around said closed circular course;

selecting a question-posing card from the deck corresponding to the color of the space that the marker was advanced to in said step of operating a chance marker;

repeating said steps of operating a chance member and selecting a question-posing item if the player's response to the question-posing card is correct; and removing a player's marker from said terminal space in the event of an improper response, and placing the death-related marker onto an adjacent predetermined space along said closed circular course until a correct response is elicited from the player located on said terminal space.

8. The method according to claim 7, wherein said step of operating a chance member to advance a player's marker includes advancing a player's marker from a periphery of the continuous spiral course to a center of the spiral course.

9. The method according to claim 8, additionally including the step of timing a player's response to a question-posing card of the separate deck.

* * * * *